US007474518B2

(12) United States Patent
Rutz et al.

(10) Patent No.: US 7,474,518 B2
(45) Date of Patent: Jan. 6, 2009

(54) ELECTRONIC DISABLING DEVICE HAVING ADJUSTABLE OUTPUT PULSE POWER

(75) Inventors: Corey Rutz, Casper, WY (US); Michael Kramer, Casper, WY (US)

(73) Assignee: Defense Technology Corporation of America, Casper, WY (US)

( * ) Notice: Subject to any disclaimer, the term of this patent is extended or adjusted under 35 U.S.C. 154(b) by 524 days.

(21) Appl. No.: 11/359,004

(22) Filed: Feb. 21, 2006

(65) Prior Publication Data

US 2008/0297970 A1 Dec. 4, 2008

Related U.S. Application Data

(60) Provisional application No. 60/657,294, filed on Feb. 28, 2005.

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 3,803,463 A 4/1974 Cover
5,588,398 A * 12/1996 Allen et al. ..... 119/822
6,636,412 B2 10/2003 Smith
7,152,990 B2 12/2006 Kukuk

OTHER PUBLICATIONS

International Search Report for International and Written Opinion for Application No. PCT/US06/06316, date of mailing Nov. 23, 2007, 8 pages.

* cited by examiner

*Primary Examiner*—Ronald W Leja
(74) *Attorney, Agent, or Firm*—Christie, Parker & Hale, LLP.

(57) ABSTRACT

An electronic disabling device with multiple adjustable power levels and a method of providing the same. The electronic disabling device includes an initial step-up voltage circuit coupled to receive an initial power from a battery and a final step-up transformer (e.g., a plain transformer, an autoformer, etc.) adapted to provide an output power. In addition, a power control circuit is coupled between the initial step-up voltage circuit and the final step-up transformer to adjust the power levels of the output power provided by the final step-up transformer.

21 Claims, 11 Drawing Sheets

ELECTRONIC DISABLING DEVICE HAVING ADJUSTABLE OUTPUT PULSE POWER

CROSS-REFERENCE TO RELATED APPLICATIONS

This application claims priority to and the benefit of U.S. Provisional Application No. 60/655,145, filed on Feb. 22, 2005, and U.S. Provisional Application No. 60/657,294, filed on Feb. 28, 2005, the entire contents of both of which are incorporated herein by reference.

FIELD OF THE INVENTION

The present invention relates generally to the field of an electronic disabling device for immobilizing a live target. More specifically, the present invention is related to an electronic disabling device having adjustable output pulse power and a method for providing the same.

BACKGROUND OF THE INVENTION

An electronic disabling device can be used to refer to an electrical discharge weapon or a stun gun. The electrical discharge weapon connects a shocking power to a live target by the use of darts projected with trailing wires from the electrical discharge weapon. The shocks debilitate violent suspects, so peace officers can more easily subdue and capture them. The stun gun, by contrast, connects the shocking power to the live target that is brought into direct contact with the stun gun to subdue the target. Electronic disabling devices are far less lethal than other more conventional weapons such as firearms.

In general, the basic ideas of the above described electronic disabling devices are to disrupt the electric communication system of muscle cells in a live target. That is, an electronic disabling device generates a high-voltage, low-amperage electrical charge. When the charge passes into the live target's body, it is combined with the electrical signals from the brain of the live target. The brain's original signals are mixed in with random noise, making it very difficult for the muscle cells to decipher the original signals. As such, the live target is stunned or temporarily paralyzed. The current of the charge may be generated with a pulse frequency that mimics a live target's own electrical signal to further stun or paralyze the live target.

To dump this high-voltage, low-amperage electrical charge, the electronic disabling device includes a shock circuit having multiple transformers and/or autoformers that boost the voltage in the circuit and/or reduce the amperage. The shock circuit may also include an oscillator to produce a specific pulse pattern of electricity and/or frequency.

Current electronic disabling devices take the lower voltage, higher current of a battery or batteries and convert it into a higher voltage, lower current output. This output must contact an individual in two places to create a full path for the energy to flow. For stun guns, this output is provided to two metal contacts on the contacting side of the device that are a short distance apart. On the electronic discharge weapons, this output is provided to two metal darts (or probes) that are propelled into the live target (or individual). The distance between the probes is normally larger than the stun gun contacts to allow for a greater effect of the live target. The metal probes are connected to the electrical circuitry in the device by thin conducting wires that carry the energy from/to the device and from/to the metal probes. With the current devices, only one level of output power is available per device package. Therefore a larger than necessary high voltage waveform may be used on a target that could have been sufficiently immobilized by a lower high voltage waveform.

In view of the foregoing, it would be desirable to create an electronic disabling device for immobilization and capture of a live target having a power control having selectable power levels such that the electronic disabling device does not apply a power level to a live target that might possibly be unsafe to that particular individual.

SUMMARY OF THE INVENTION

The present invention relates to a system and/or an associated method for providing an electronic disabling device with a level of power control. The invention provides the electronic disabling device with multiple selectable power levels in one device package. This would allow a user of the electronic disabling device to start with a low power setting (e.g., the lowest power setting) and if the power was not effective, incrementally increase the power until it was effective. This adds a level of safety such that the user does not apply a power level to a live target that might possibly be unsafe to that particular individual.

In one exemplary embodiment of the present invention, an electronic disabling device has multiple adjustable power levels to immobilize a live target. The electronic disabling device includes a battery, an initial step-up voltage circuit, a final step-up transformer (e.g., a plain transformer, an autoformer, etc.), a first electrical output contact, a second electrical output contact, and a power control circuit. The initial step-up voltage circuit is coupled to receive an initial power from the battery. The final step-up transformer provides an output power. The output power is received by the first electrical output contact, and the second electrical output contact receives the output power from the first electrical output through the live target. Here, the power control circuit is coupled between the initial step-up voltage circuit and the final step-up transformer to adjust the power levels of the output power provided by the final step-up transformer.

In one exemplary embodiment of the present invention, a method provides an electronic disabling device with multiple adjustable power levels to immobilize a live target. The method includes: providing an input power from a battery to an initial step-up voltage circuit; stepping-up a voltage of the input power through the initial step-up voltage circuit; adjusting and transforming the input power to an output power having an adjusted power level through a final step-up transformer (e.g., a plain transformer, an autoformer, etc.); and providing the output power having the adjusted power level to an electrical output contact. Here, the adjusted power level of the output power is selected by a user of the electronic disabling device.

A more complete understanding of the electronic disabling device having adjustable output pulse power will be afforded to those skilled in the art and by a consideration of the following detailed description. Reference will be made to the appended sheets of drawings which will first be described briefly.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
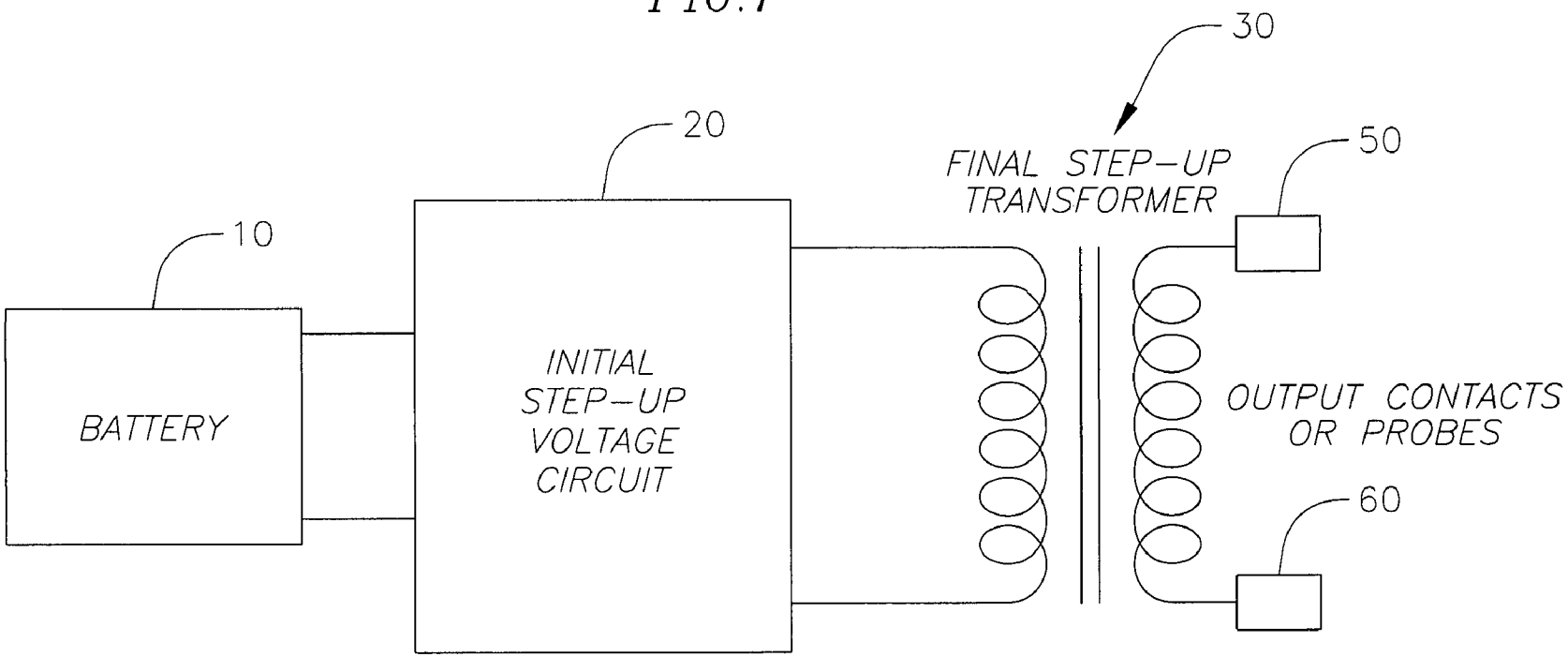
FIG. 1 illustrates an exemplary electronic disabling device.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

There may be parts shown in the drawings, or parts not shown in the drawings, that are not discussed in the specification as they are not essential to a complete understanding of the invention. Like reference numerals designate like elements.

Referring to FIG. 1, an example of an electronic disabling device is shown to include a battery 10, an initial step-up voltage circuit 20, a trigger (not shown), a final step-up transformer 30, a first electrically conductive output contact (or probe) 50, and a second electrically conductive output contact (or probe) 60. Each of the contacts 50, 60 can be connected to the housing of the electronic disabling device by electrically conductive wires. Further, although the final step-up transformer 30 is exemplary shown in FIG. 1 as being a plain transformer, it should be recognized by those skilled in the art that the present invention is not thereby limited. For example, a final step-up transformer according to an embodiment of the present invention can be realized as being an autoformer.

In operation, an electrical charge which travels into the contact 50 is activated by squeezing the trigger. The power for the electrical charge is provided by the battery 10. That is, when the trigger is turned on, it allows the power to travel to the initial step-up voltage circuit 20. The initial step-up voltage circuit 20 includes a first transformer that receives electricity from the battery 10 and causes a predetermined amount of voltage to be transmitted to and stored in a storage capacitor through a number of pulses. Once the storage capacitor stores the predetermined amount of voltage, it is able to discharge an electrical pulse into the final step-up transformer 30 (e.g., a second transformer and/or autoformer). The output from the final step-up transformer 30 then goes into the first contact 50. When the first and second contacts 50, 60 contact a live target, charges from the first contact 50 travel into tissue in the target's body, then through the tissue into the second contact 60, and then to a ground. Pulses are delivered from the first contact 50 into target's tissue for a predetermined number of seconds. The pulses cause contraction of skeletal muscles and make the muscles inoperable, thereby preventing use of the muscles in locomotion of the target.

In one embodiment, the shock pulses from an electronic disabling device can be generated by an oscillator such as a classic relaxation oscillator that produces distorted saw-tooth pulses to the storage capacitor. An electronic disabling device having the relaxation oscillator is shown as FIG. 2.

Figure 2:
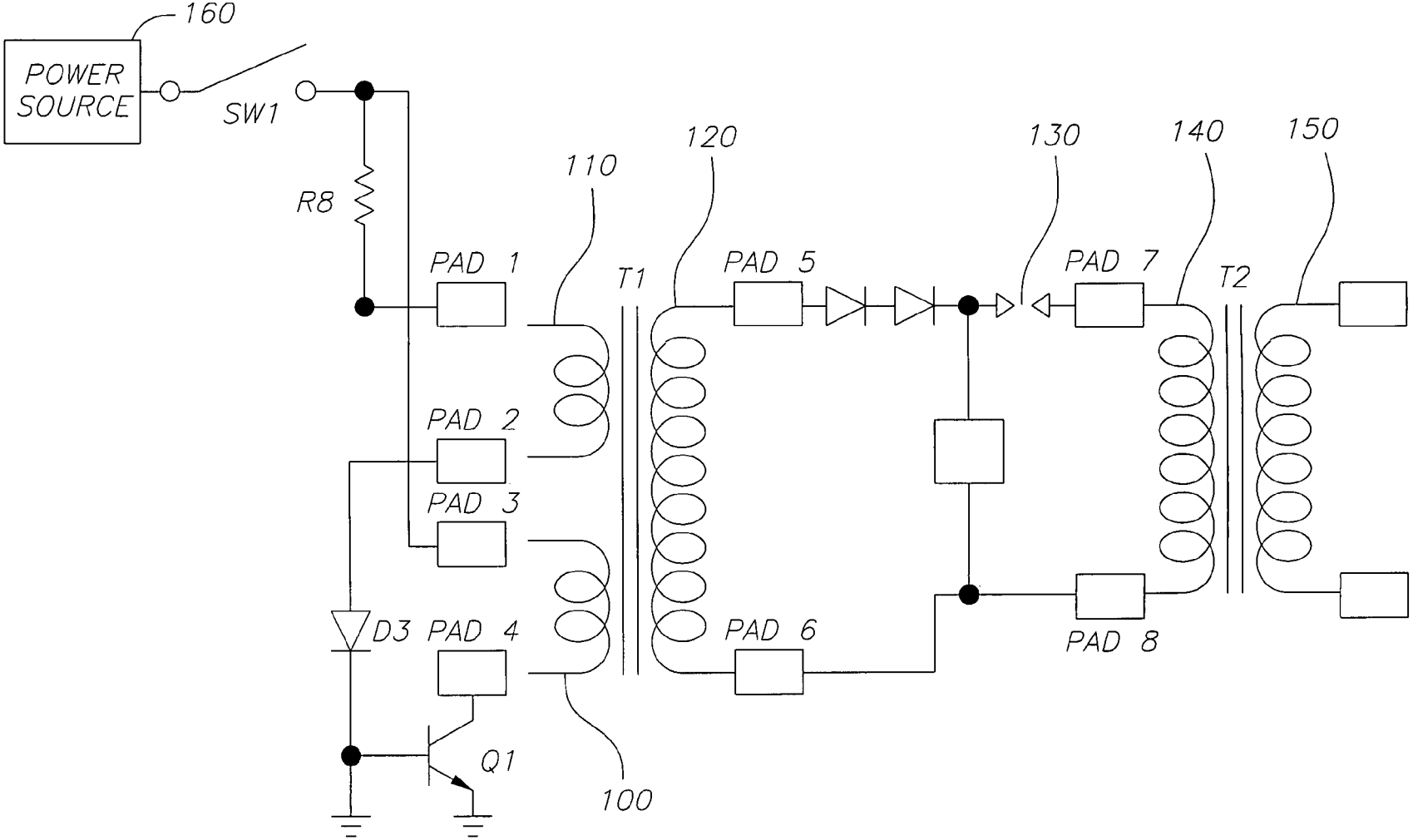
FIG. 2 illustrates an exemplary electronic disabling device using a relaxation oscillator.

Referring to FIG. 2, power is supplied to the relaxation oscillator from a battery source 160. The closure of a switch SW1 connects the battery source 160 with an inverter transformer TI. In FIG. 2, a tickler coil 110 of the inverter transformer T1 between PAD1 and PAD2 is used to form the classic relaxation oscillator. A primary coil 100 of the inverter transformer T1 is connected between PAD3 and PAD4. Upon closure of the power switch SW1, the primary coil 100 of the inverter transformer T1 is energized as a current flows through the coil 100 from PAD3 to PAD4 as the power transistor Q1 is turned ON. The tickler coil 110 of the inverter transformer T1 is energized upon closure of the power switch SW1 through a resistor R8 and a diode D3. The current through the tickler coil 110 also forms the base current of the power transistor Q1, thus causing it to turn ON. Since the tickler coil 110 and the primary coil 100 of the inverter transformer T1 oppose one another, the current through power transistor Q1 causes a flux in the inverter transformer T1 to, in effect, backdrive the tickler coil 110 and cut off the power transistor Q1 base current, thus causing it to turn OFF and forming the relaxation oscillator.

In addition, a secondary coil 120 of the inverter transformer T1 between PAD5 and PAD6 is connected to a pair of diodes D4 and D5 that form a half-wave rectifier. The pair of diodes D4 and D5 are then serially connected with a spark gap 130 and then with a primary coil 140 of the output transformer T2. The primary coil 140 of the output transformer T2 is connected between PAD7 and PAD8. The spark gap 130 is selected to have particular ionization characteristics tailored to a specific spark gap breakover voltage to "tune" the output of the shock circuit.

In more detail, when sufficient energy is charged on a storage capacitor, a gas gap breaks down on the spark gap 130 such that the spark gap 130 begins to conduct electricity. This energy is then passed through the primary coil 140 of output or step up transformer T2.

However, the present invention is not limited to the above described exemplary embodiment. For example, an embodiment of an electronic disabling device can include a digital oscillator coupled to digitally generate switching signals or an independent oscillator 210 as shown in FIG. 3.

Figure 3:
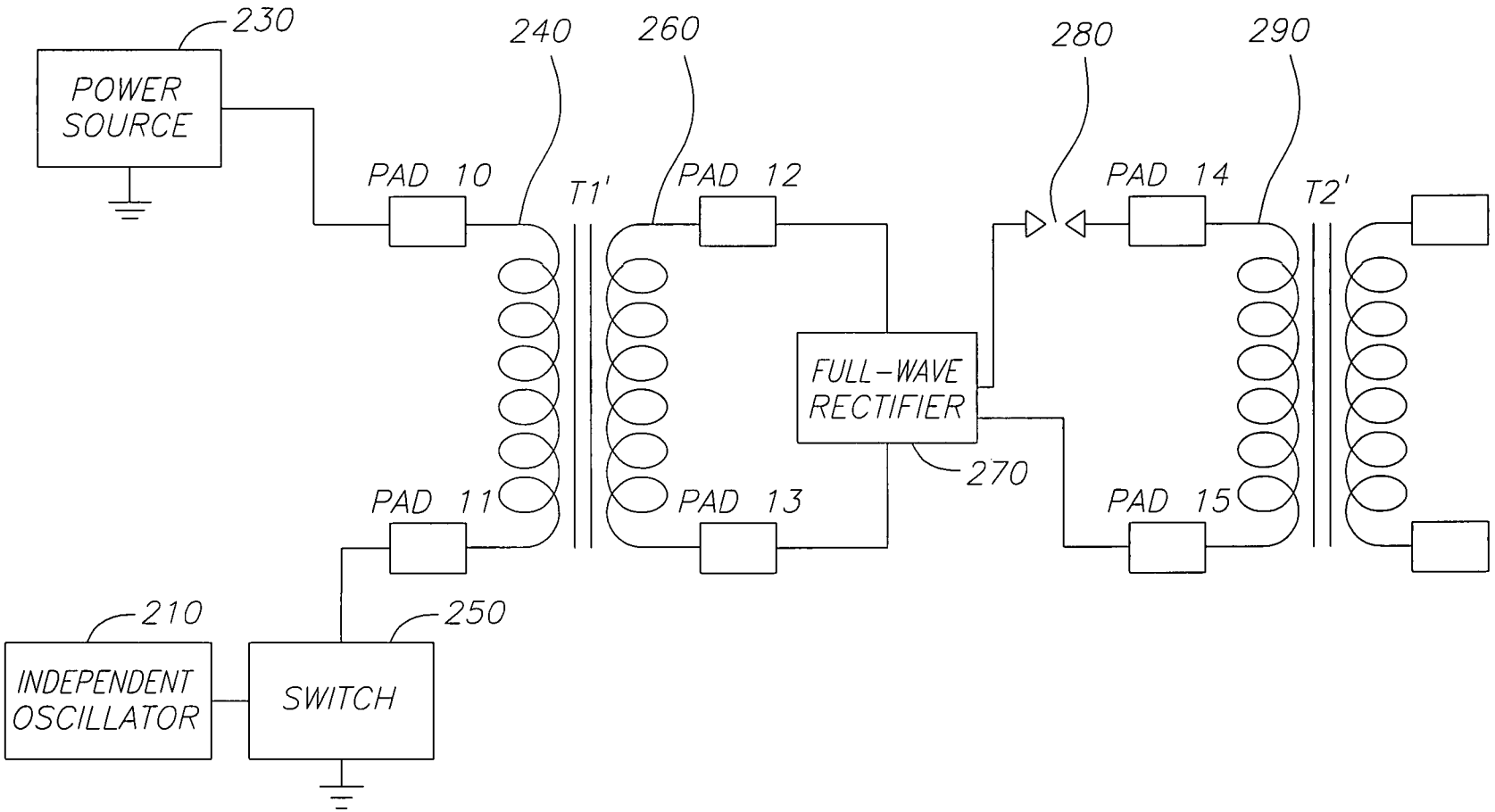
FIG. 3 illustrates an exemplary electronic disabling device using an independently driven oscillator.

In the disabling device of FIG. 3, a power is supplied from a battery source 230 to an inverter transformer TI'. In FIG. 3, a primary coil 240 of the inverter transformer T1' is connected between PAD10 and PAD11. A power switch 250 is connected between the inverter transformer T1' and a ground. The power switch 250 (or a base or a gate of the power switch 250) is also connected to the independent oscillator 210.

In more detail, the primary coil 240 of the inverter transformer T1' is energized as current flows through the coil 240 from PAD10 to PAD11 as the switch (or transistor) 250 is turned ON. The independent oscillator 210 is coupled to the switch 250 (e.g., at the base or the gate of the switch 250) to turn the switch 250 ON and OFF. A secondary coil 260 of the inverter transformer T1' between PAD12 and PAD13 is connected to a full-wave rectifier 270. The full-wave rectifier 270 is then serially connected with a spark gap 280 and then with a primary coil 290 of the output transformer T2'. The primary coil 290 of the output transformer T2' is connected between PAD14 and PAD15.

In operation, the oscillator 210 creates a periodic output that varies from a positive voltage (V+) to a ground voltage. This periodic waveform creates the drive function that causes current to flow through the primary coil 240 of the transformer T1'. This current flow causes current to flow in the secondary coil 260 of the transformer T1' based on the turn ratio of the transformer T1'. A power current from the battery source 230 then flows in the primary coil 240 of the transformer T1' only when the switch 250 is turned on and is in the process of conducting. The full wave bridge rectifier 270 then rectifies the voltage from the power source 230 when the switch 250 is caused to conduct.

In view of the foregoing, electronic disabling devices with high powered shocks can be formed. However, the propriety of forming weapons capable of producing such high powered shocks may be in question because the enhanced shocks may increase the weapons lethality, especially where circuits operating at a fraction of the power ranges that can be achieved by these disabling devices (e.g., at power levels as low as 1.5 watts and 0.15 joules per pulse at ten pps) can completely disable most test subjects. In addition, some seventy deaths have occurred proximate to use of such weapons. As such, using these weapons at high power may run contrary to the idea that electronic disabling devices are intended to subdue and capture live targets without seriously injuring them.

In accordance with an embodiment of the present invention, an electronic disabling device is provided with multiple selectable power levels in one device package. This would allow a user of the electronic disabling device to start with a low power setting (e.g., the lowest power setting) and if the power was not effective, incrementally increase the power until it was effective. This adds a level of safety such that the user does not apply a power level to a live target that might possibly be unsafe to that particular individual.

Figure 4:
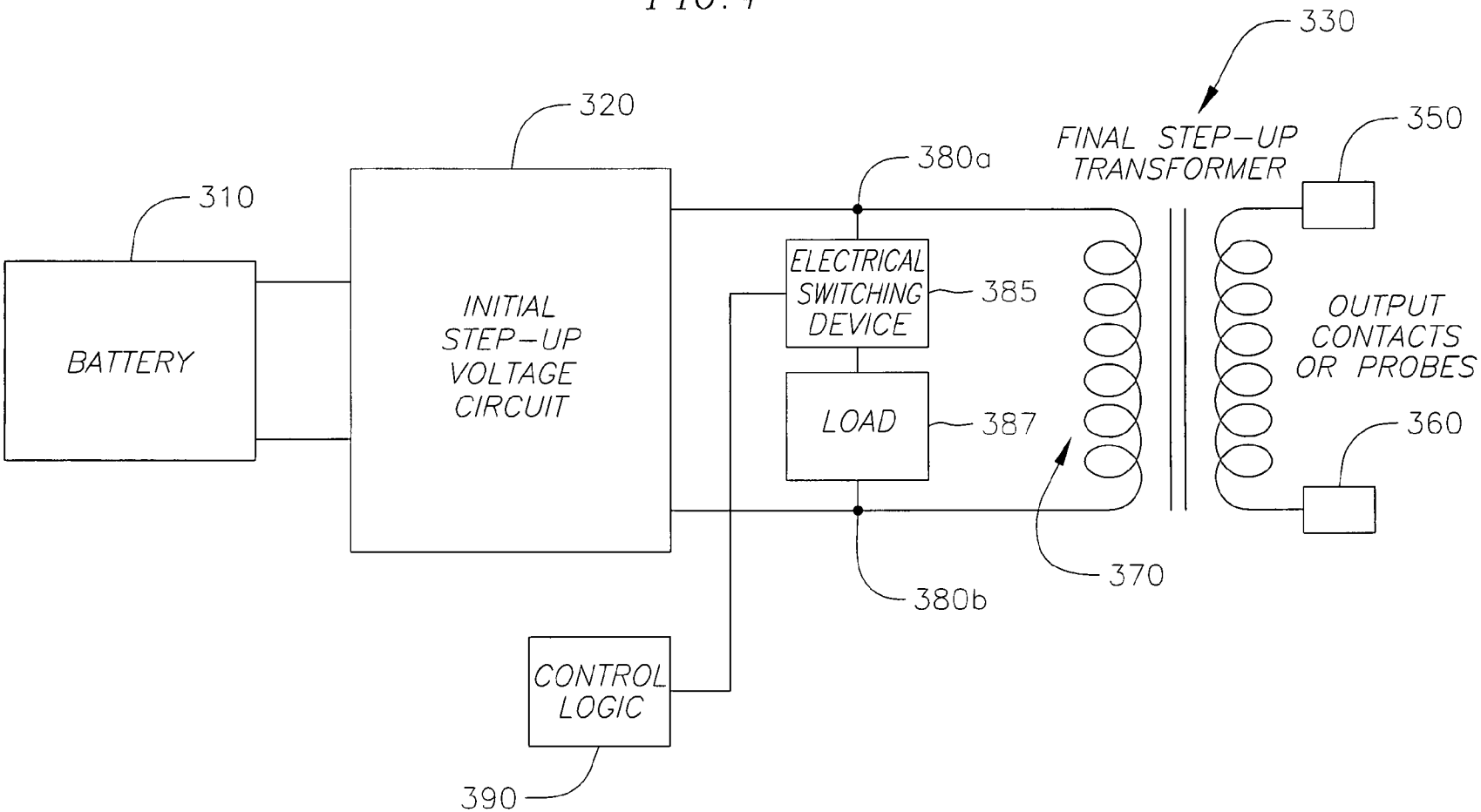
FIG. 4 illustrates an exemplary electronic disabling device having a load parallel to a primary coil.

Referring to FIG. 4, an electronic disabling device in accordance with one embodiment of the present invention includes a battery 310, an initial step-up voltage circuit 320, a trigger (not shown), a final step-up transformer 330, a first electrically conductive output contact (or probe) 350, and a second electrically conductive output contact (or probe) 360. Also, in FIG. 4, a primary coil (or winding) 370 of the final step-up transformer 330 is connected between a first node 380*a* and a second node 380*b*. In this embodiment, an electrical switching device 385 and a load 387 are also shown to be connected between the first node 380*a* and the second node 380*b* and in parallel with the coil 370. The load 387 can be a resistive, capacitive, and/or inductive load. The switching device 385 is connected with and controlled by a control logic 390. As such, the electrical switching device 385 of FIG. 4 allows switching in (and out) the parallel load 387 to the primary coil 370 of the final step-up transformer 330.

In more detail, the switching device 385 would be controlled by the additional control logic 390 added to the circuit 320 of the electronic disabling device. The additional control logic 390 allows a control input from a user such that the output pulse power of the electronic disabling device can be adjusted by either switching in or switching out the parallel load 387 to the primary coil 370 of the final step-up transformer 330.

Figure 5:
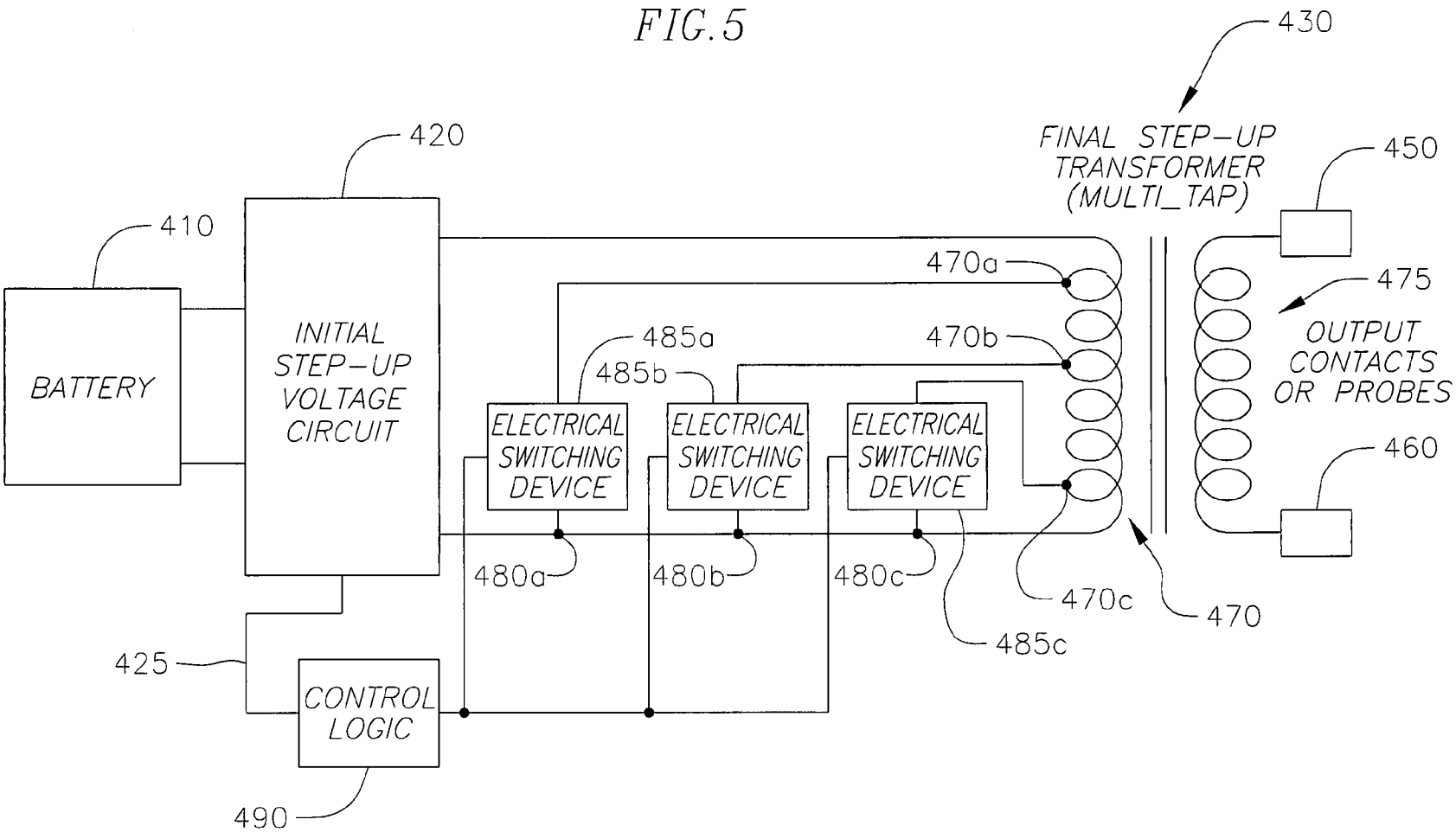
FIG. 5 illustrates an exemplary electronic disabling device having multiple taps.

Referring to FIG. 5, an electronic disabling device in accordance with another embodiment of the present invention includes a battery 410, an initial step-up voltage circuit 420, a trigger (not shown), a final step-up transformer 430, a first electrically conductive output contact (or probe) 450, and a second electrically conductive output contact (or probe) 460. Also, in FIG. 5, a primary coil (or winding) 470 of the final step-up transformer 430 includes a first tap 470*a*, a second tap 470*b*, and a third tap 470*c*. In this embodiment, a first electrical switching device 485*a* is shown to be connected between the first tap 470*a* and a first node 480*a*, a second electrical switching device 485*b* is shown to be connected between the second tap 370*b* and a second node 480*b*, and a third electrical switching device 485*c* is shown to be connected between the third tap 470*c* and a third node 480*c*. The first, second, and third switching devices 485*a*, 485*b*, and 485*c* are connected with and controlled by a control logic 490. As such, the electrical switching devices 485*a*, 485*b*, and 485*c* of FIG. 5 change the primary coil 470 of the final step-up transformer 430 from a single winding configuration (e.g., as shown in FIG. 1) to a multiple winding configuration with the first, second, and third taps 470*a*, 470*b*, and 470*c*.

In more detail, the electrical switching devices 485*a*, 485*b*, and 485*c* allow the primary coil 470 to be shortened using the first, second, and third taps 470*a*, 470*b*, and 470*c* of the primary coil 470 and connecting them to the first, second, and third nodes (or a ground) 480*a*, 480*b*, and 480*c*, respectively. This can effectively reduce the number of windings in the primary coil 470 such that a smaller step-up voltage can be obtained on a secondary coil 475 connected with the first and second electrically conductive output contacts 450 and 460. Any number of taps can be added to the primary winding, and the present invention is not thereby limited by the embodiment of FIG. 5. Also, the control logic 490 is added to control the switching devices 485*a*, 485*b*, and 485*c* to allow a control input from a user. In addition, this control logic 490 is connected to the initial step-up voltage circuit 420 via a connection 425 to allow for an adjustment of the pulse rate of the initial step-up voltage circuit 420 to keep the same output pulse rate for the device.

Figure 6:
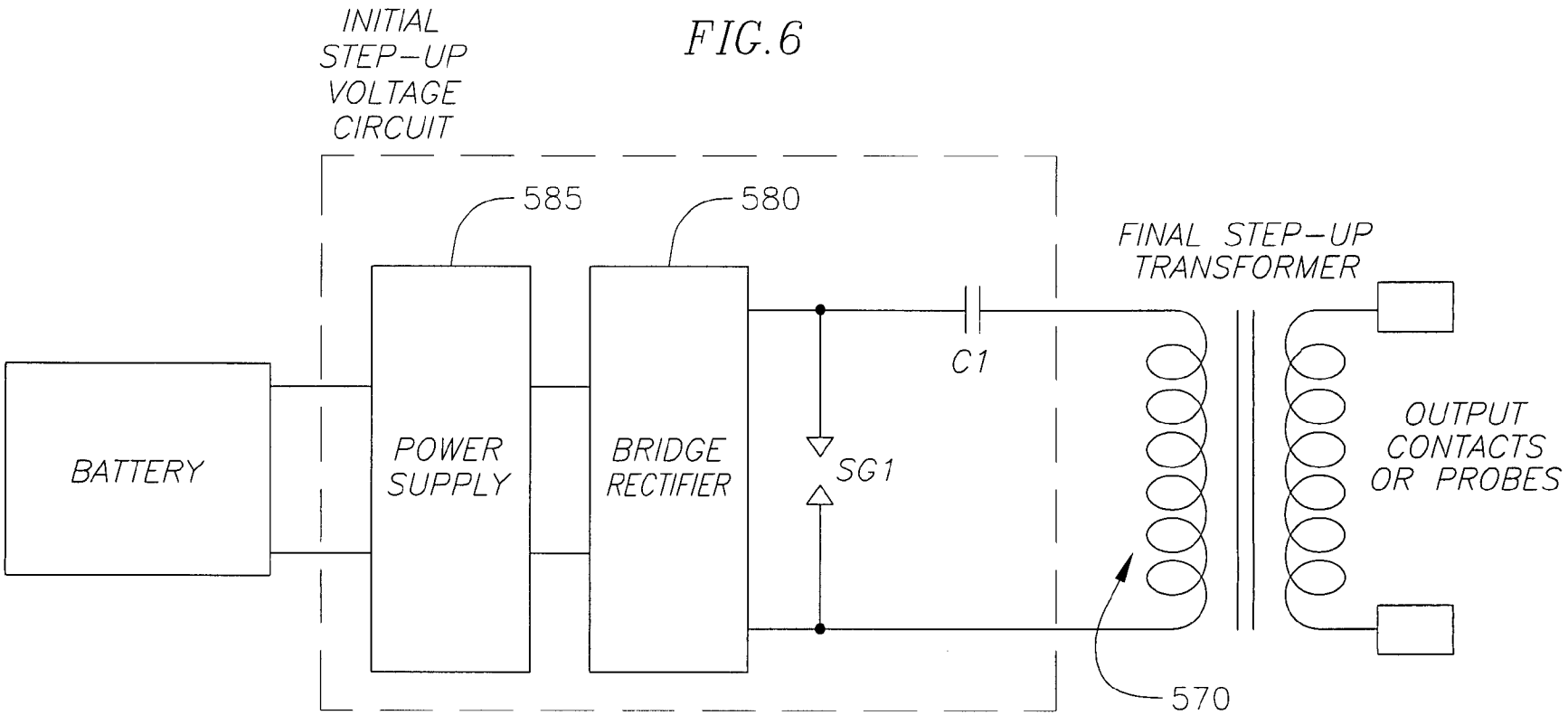
FIG. 6 illustrates an exemplary electronic disabling device for producing a sinusoidal output waveform.
Figure 8:
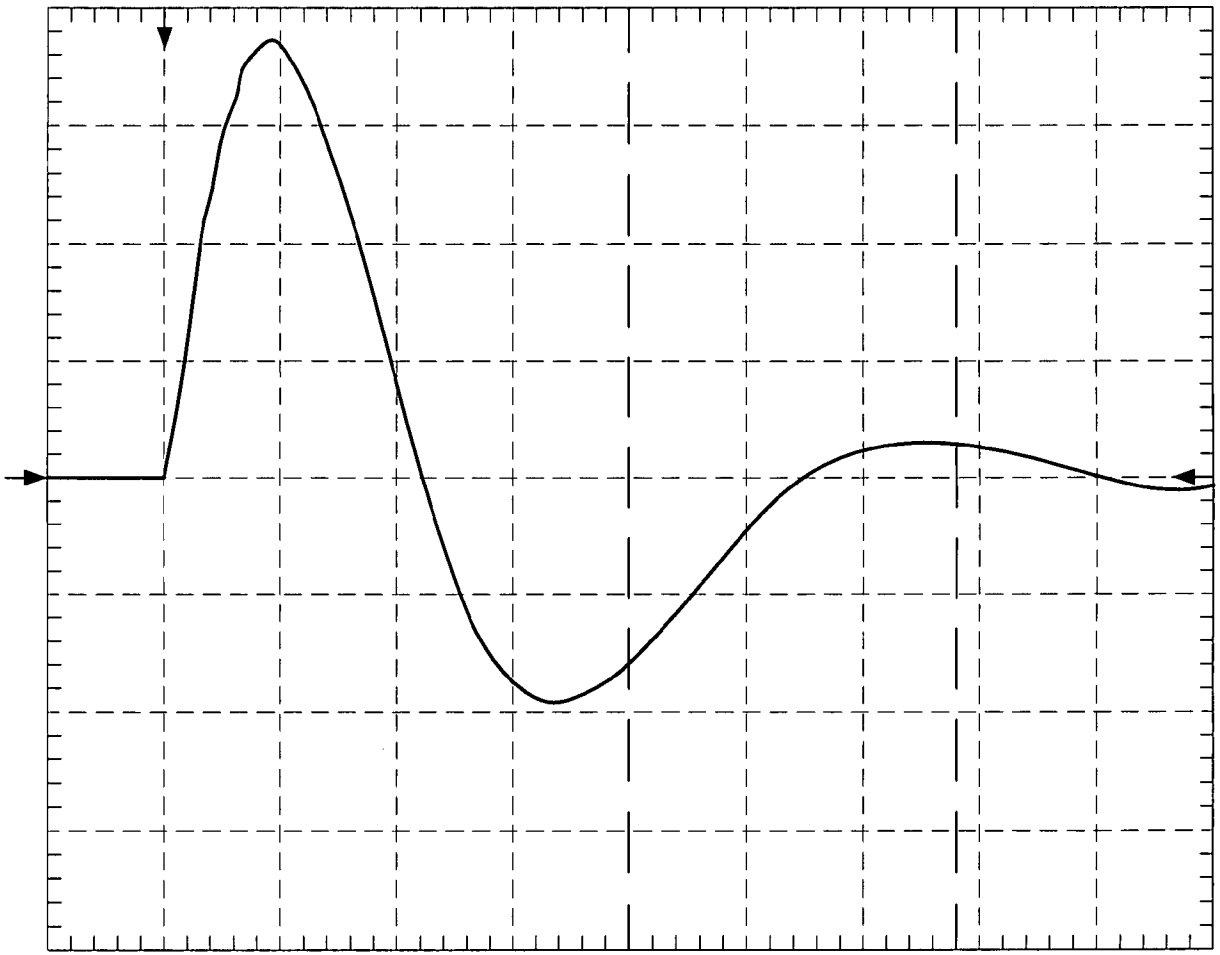
FIG. 8 illustrates an exemplary sinusoidal output waveform.

FIG. 6 shows a view into an initial step-up circuit of an electronic disabling device connected with a final step-up transformer of the electronic disabling device. The initial step-up circuit includes a power supply 585 having an oscillator (e.g., the oscillator shown in FIG. 2 or 3 for providing a pulse rate), a bridge rectifier 580, a spark gap SG1, and a storage capacitor C1. Here, the storage capacitor C1 is connected to a primary coil 570 of the final step-up transformer in series, and the spark gap SG1 is connected to the storage capacitor C1 and the primary coil 570 in parallel. As such, the spark gap SG1 and the storage capacitor C1 are positioned to provide a sinusoidal output waveform as shown in FIG. 8.

In more detail, an energy from the bridge rectifier 580 of the initial step-up voltage circuit (e.g., a full-wave bridge rectifier circuit having at least four diodes) is initially used to charge up one plate of the storage capacitor C1. The spark gap SG1 fires whenever the voltage of the storage capacitor C1 reaches a fixed breakdown voltage of the spark gap SG1, and the stored energy discharges through the primary coil 570. In addition, because the storage capacitor C1 and the primary coil 570 are connected to create a tank circuit, as the capacitor C1 discharges, the primary coil 570 will try to keep the current in the circuit moving, so it will charge up the other plate of the capacitor C1. Once the field of the primary coil 570 collapses, the capacitor C1 has been partially recharged (but with the opposite polarity), so it discharges again through the primary coil 570. As such, the sinusoidal output waveform as shown in FIG. 8 is provided by the electronic disabling device of FIG. 6.

Figure 7:
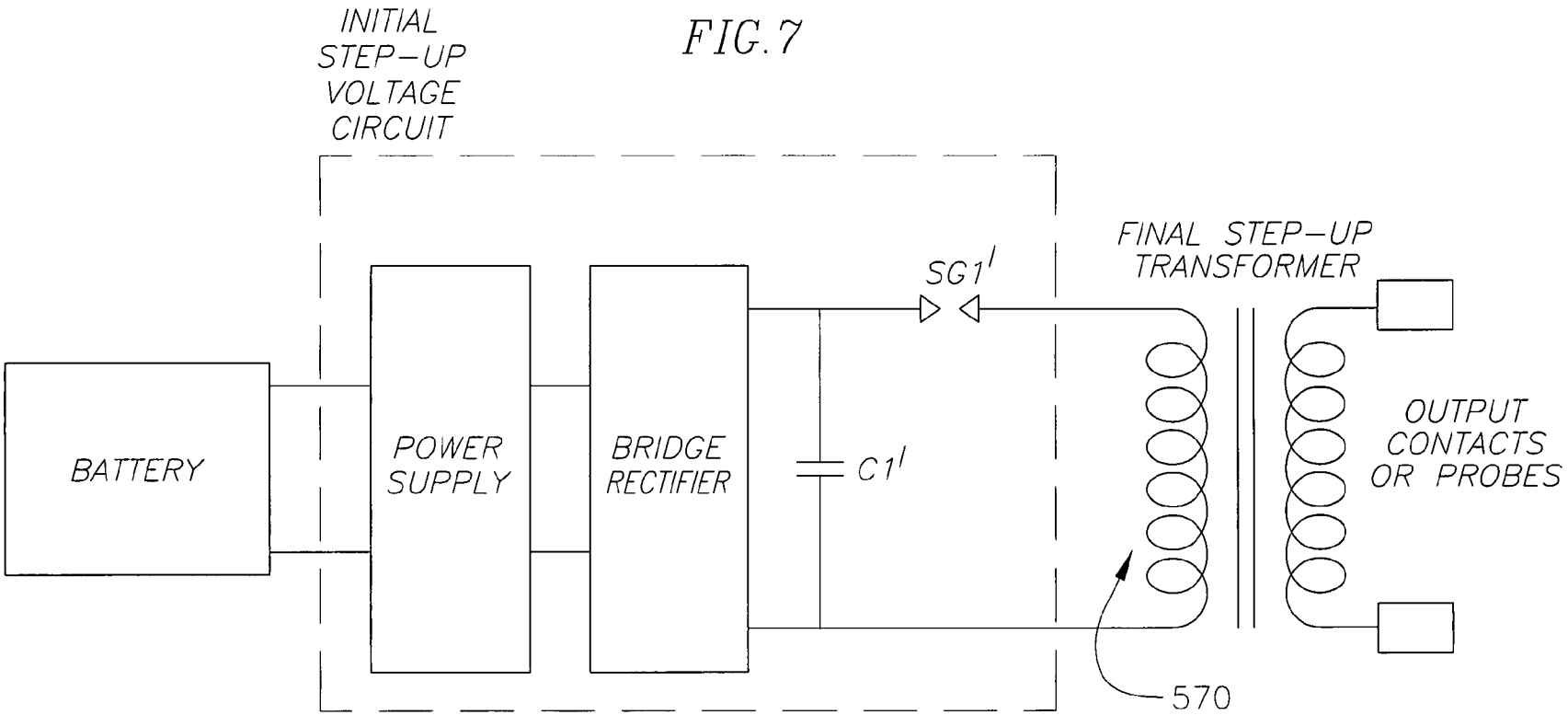
FIG. 7 illustrates an exemplary electronic disabling device for producing a half-cycle uni-pulse output waveform.

Alternatively, as shown in FIG. 7, a spark gap SG1' is connected to a primary coil 570' of a final step-up transformer in series, and a storage capacitor C1' is connected to the spark gap SG1' and the primary coil 570' in parallel. As such, the spark gap SG1' and the storage capacitor C1' are positioned to provide a half-cycle uni-pulse output waveform as shown in FIG. 9.

Figure 9:
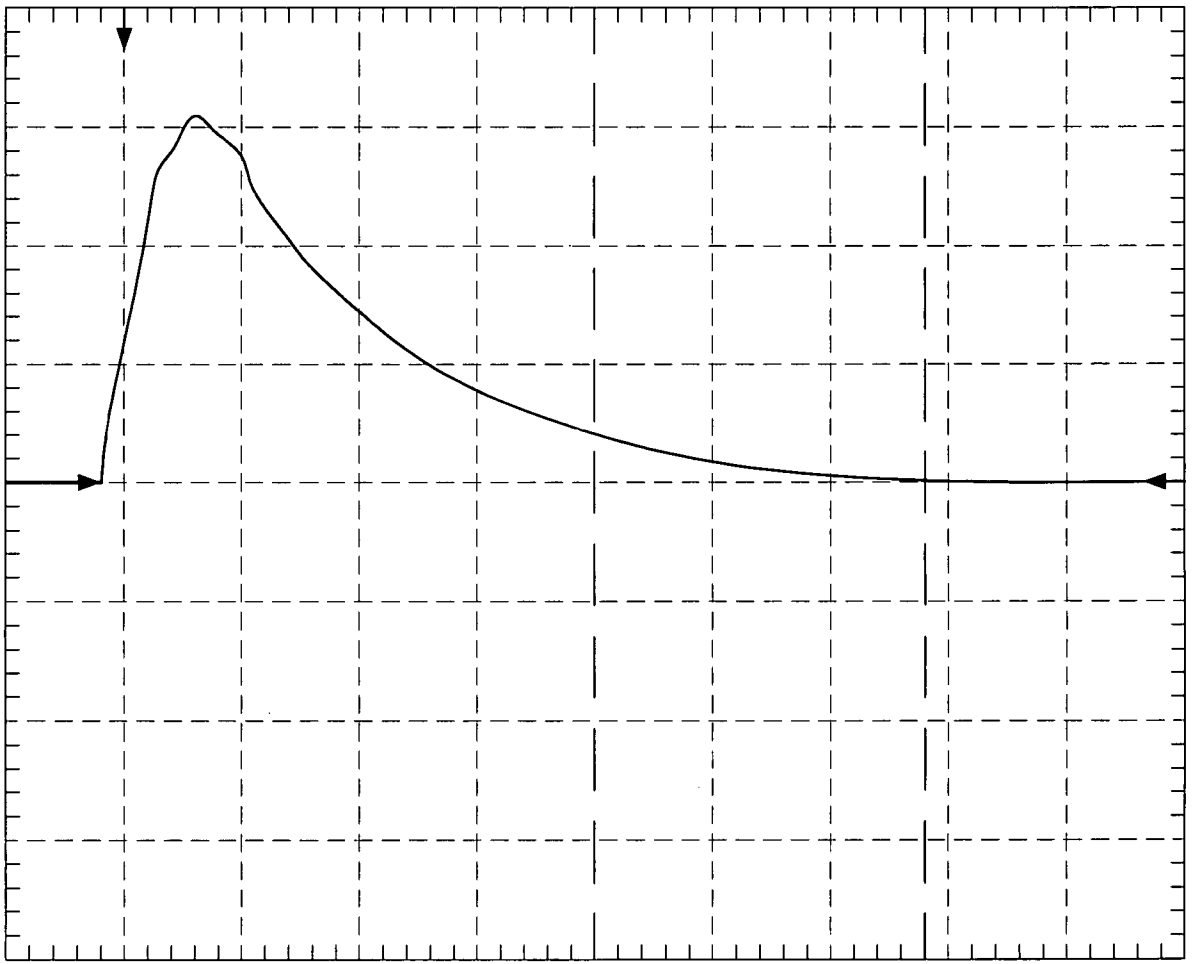
FIG. 9 illustrates an exemplary half-cycle uni-pulse output waveform.

In more detail, the spark gap SG1' and the storage capacitor C1' of FIG. 7 are positionally switched as compared to the spark gap SG1 and the storage capacitor C1 to remove the tank circuit and to produce the half-cycle uni-pulse output waveform as shown in FIG. 9. As such, the electronic disabling device of FIG. 7 produces a mostly positive half-cycle pulse waveform or a mostly negative half-cycle pulse waveform. Also, this indicates that electrons flow mainly in one direction with fewer electrons flowing in the opposite direction. That is, the opposite amplitude in the sinusoidal output waveform of FIG. 8 is caused by the electrons flowing in the opposite direction for part of the cycle.

Figure 10:
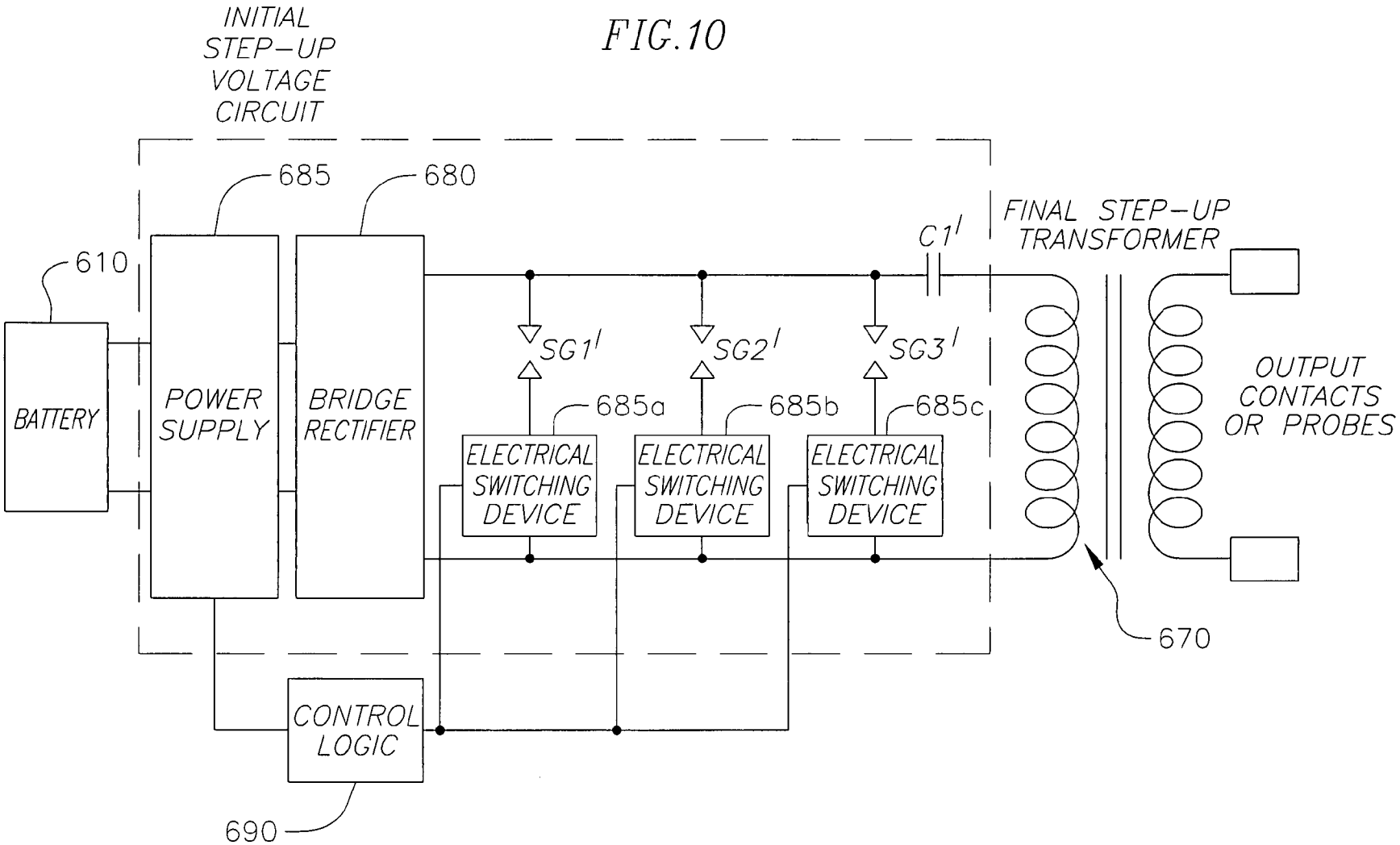
FIG. 10 illustrates an exemplary electronic disabling device for producing a sinusoidal output waveform having multiple spark gaps.

Referring to FIG. 10, an electronic disabling device in accordance with one embodiment of the present invention includes a battery 610, a power supply 685, a bridge rectifier circuit 680 of an initial step-up voltage circuit, a trigger (not shown), and a primary coil 670 of a final step-up transformer. In addition, the electronic disabling device of FIG. 10 includes a first spark gap SG1', a second spark gap SG2', a third spark gap SG3', and a storage capacitor C1'. Here, the storage capacitor C1' is connected to the primary coil 670 of the final step-up transformer in series. Also, as shown in FIG. 10, a first electrical switching device 685*a* is used to connect/disconnect the first spark gap SG1' to the storage capacitor C1' and the primary coil 670 in parallel, a second electrical switching device 685*b* is used to connect/disconnect the second spark gap SG2' to the storage capacitor C1' and the primary coil 670 in parallel, and a third electrical switching device 685*c* is used to connect/disconnect the third spark gap SG3' to the storage capacitor C1' and the primary coil 670 in parallel. The first, second, and third switching devices 685*a*, 685*b*, and 685*c* are connected with and controlled by a control logic 690. As such, the multiple spark gaps SG1', SG2', and SG3' and switching devices 685*a*, 685*b*, and 685*c* allow a user of the electronic disabling device to adjust the output power of the device. That is, by allowing the user of the electronic disabling device to select the appropriate spark gaps SG1', SG2', and SG3', the output power of the electronic disabling device of FIG. 10 can be controlled. Here, the control logic 690 for the selectable spark gaps SG1', SG2', and SG3' would also provide an input to the power supply 685 including an oscillator to keep the same output pulse rate.

Figure 11:
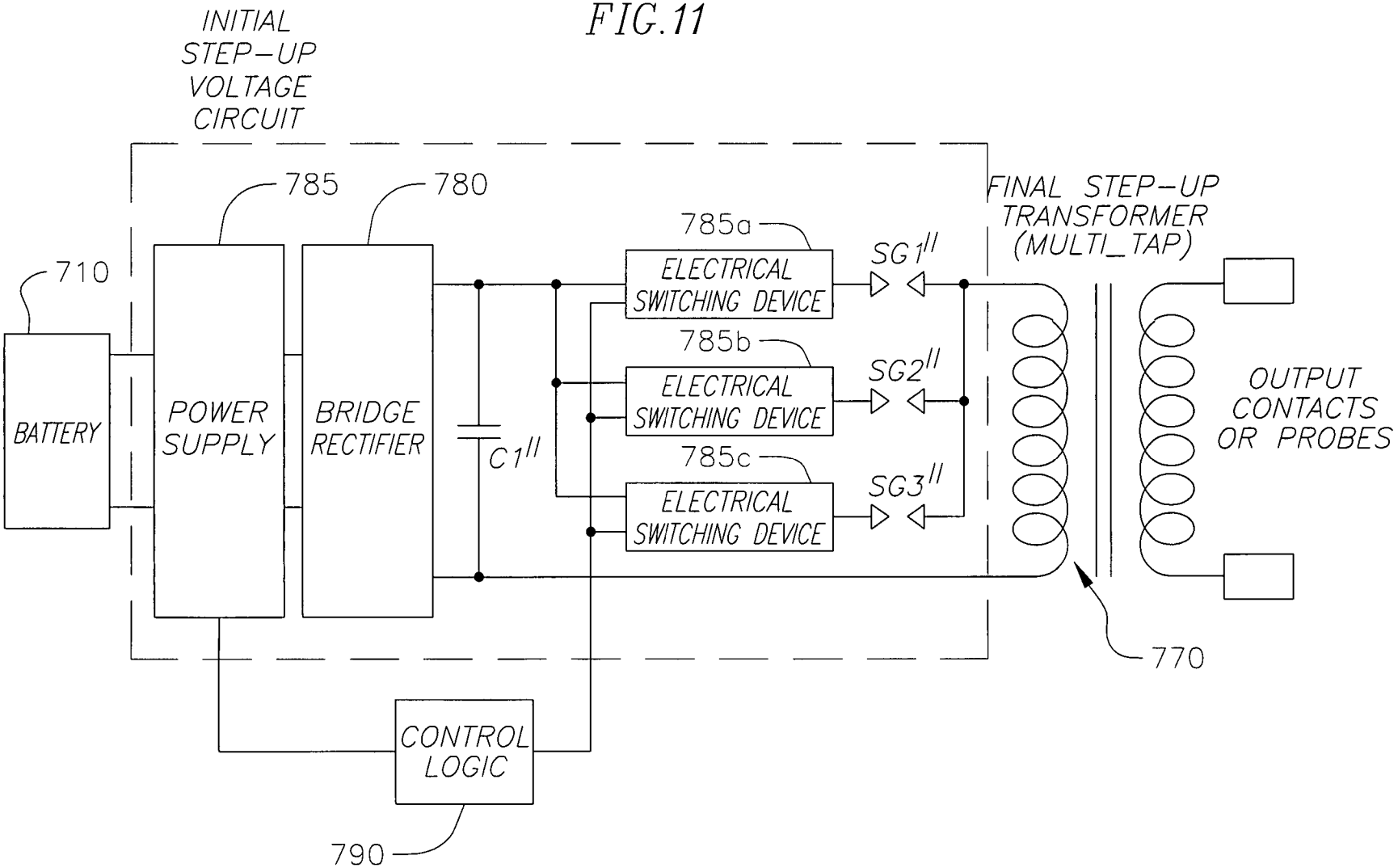
FIG. 11 illustrates an exemplary electronic disabling device for producing a half-cycle uni-pulse output waveform having multiple spark gaps.

Referring to FIG. 11, an electronic disabling device in accordance with another embodiment of the present invention includes a battery 710, a power supply 785, a rectifier circuit 780 of an initial step-up voltage circuit, a trigger (not shown), and a primary coil 770 of a final step-up transformer. In addition, the electronic disabling device of FIG. 11 includes a first spark gap SG1", a second spark gap SG2", a third spark gap SG3", and a storage capacitor C1". Here, a first electrical switching device 785*a* is used to connect/disconnect the first spark gap SG1' to the primary coil 770 in series, a second electrical switching device 785*b* is used to connect/disconnect the second spark gap SG2" to the primary coil 770 in series, and a third electrical switching device 785*c* is used to connect/disconnect the third spark gap SG3" to the primary coil 770 in series. In addition, as shown in FIG. 11, the storage capacitor C1" is connected to the primary coil 770 of the final step-up transformer in parallel with at least one of the spark gaps SG1", SG2", and SG3" connected to the primary coil 770 in series. The first, second, and third switching devices 785*a*, 785*b*, and 785*c* are connected with and controlled by a control logic 790. As such, the multiple spark gaps SG1", SG2", and SG3" and switching devices 785*a*, 785*b*, and 785*c* allow a user of the electronic disabling device to adjust the output power. That is, similar to the device of FIG. 10, by allowing the user of the electronic disabling device to select the appropriate spark gaps SG1", SG2", and SG3", the output power of the electronic disabling device of FIG. 11 can be controlled. Here, the control logic 790 for the selectable spark gaps SG1", SG2", and SG3" would also provide input to the power supply 785 including an oscillator to keep the same output pulse rate.

In view of the forgoing, FIGS. 10 and 11 show that, by adding multiple spark gaps and switching devices, the output power of an electronic device can be adjusted in a way that differs from the embodiments of FIGS. 4 and 5 for either the sinusoidal output waveform or the half-cycle uni-pulse output waveform. In FIGS. 10 and 11, the spark gaps control how much voltage is stored on the storage capacitor by not making a complete circuit until a particular voltage is reached. That is, the spark gaps according to an embodiment of the present invention include at least a first spark gap having a first breakdown voltage and at least a second spark gap having a second breakdown voltage differing from the first break down voltage. The controlled spark gaps (e.g., SG1', SG2', SG3' or SG1", SG2", SG3") then only provide a complete circuit for a very small amount of time for allowing the storage capacitor (e.g., C1' or C1") to dump energy into the primary coil (e.g., 670 or 770) of the final step-up transformer.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electronic disabling device having multiple adjustable power levels to immobilize a live target, the electronic disabling device comprising:
- a battery;
- an initial step-up voltage circuit coupled to receive an initial power from the battery;
- an final step-up transformer adapted to provide an output power;
- an electrical output contact coupled to receive the output power from the final step-up transformer; and
- a power control circuit coupled between the initial step-up voltage circuit and the final step-up transformer to adjust the power levels of the output power provided by the final step-up transformer.

2. The electronic disabling device of claim 1, wherein the power control circuit comprises an electrical switching device, a load adapted to reduce a power level of the output power provided by the final step-up transformer, and a control logic adapted to receive a control input from a user of the electronic disabling device and to control the electrical switching device to either switch in or switch out the load.

3. The electronic disabling device of claim 2, wherein the final step-up transformer comprises a primary coil connected between a first node and a second node and wherein the electrical switching device and the load are also connected between the first node and the second node and in parallel with the primary coil.

4. The electronic disabling device of claim 3, wherein the load comprises at least one of a resistive load, a capacitive load, or an inductive load.

5. The electronic disabling device of claim 1, wherein the final step-up transformer comprises a primary coil comprising a tap and wherein the power control circuit comprises an electrical switching device coupled to the tap and a control logic coupled between the initial step-up voltage circuit and the electrical switching device.

6. The electronic disabling device of claim 5, wherein the electrical switching device is coupled between a node and the tap of the primary coil to effectively reduce the number of windings in the primary coil when the electrical switching device electrically connects the tap to the node.

7. The electronic disabling device of claim 5, wherein the control logic is coupled to the initial step-up voltage circuit to allow for an adjustment of a pulse rate of the initial step-up voltage circuit.

8. The electronic disabling device of claim 1, wherein the final step-up transformer comprises a primary coil comprising a plurality of taps and wherein the power control circuit comprises a plurality of electrical switching devices respectively coupled to the plurality of taps and a control logic coupled between the initial step-up voltage circuit and the plurality of electrical switching devices.

9. The electronic disabling device of claim 8, wherein the plurality of electrical switching devices are respectively coupled between a plurality of nodes and the plurality of taps to effectively reduce the number of windings in the primary coil when one or more of the electrical switching devices are switched on.

10. The electronic disabling device of claim 8, wherein the control logic is coupled to the initial step-up voltage circuit to allow for an adjustment of a pulse rate of the initial step-up voltage circuit.

11. The electronic disabling device of claim 1, wherein the power control circuit comprises a plurality of spark gaps, a plurality of electrical switching devices respectively coupled to the plurality of spark gaps, and a control logic electrically coupled between the initial step-up voltage circuit and the plurality of electrical switching devices.

12. The electronic disabling device of claim 11, wherein the plurality of electrical switching devices switch in or switch out the plurality of spark gaps to adjust a power level of the output power provided by the final step-up transformer.

13. The electronic disabling device of claim 11, wherein the control logic is coupled to the initial step-up voltage circuit to allow for an adjustment of a pulse rate of the initial step-up voltage circuit.

14. The electronic disabling device of claim 11, wherein the final step-up transformer comprises a primary coil and wherein the plurality of electrical switching devices electrically connect/disconnect the plurality of spark gaps with the primary coil in series.

15. The electronic disabling device of claim 11, wherein the final step-up transformer comprises a primary coil and wherein the plurality of electrical switching devices electrically connect/disconnect the plurality of spark gaps with the primary coil in parallel.

16. The electronic disabling device of claim 11, wherein the plurality of spark gaps comprises a first spark gap having a first breakdown voltage and a second spark gap having a second breakdown voltage differing from the first breakdown voltage.

17. A method of providing an electronic disabling device with multiple adjustable power levels to immobilize a live target, the method comprising:

providing an input power from a battery to an initial step-up voltage circuit;

stepping-up a voltage of the input power through the initial step-up voltage circuit;

adjusting and transforming the input power to an output power having an adjusted power level through a final step-up transformer; and providing the output power having the adjusted power level to an electrical output contact, wherein the adjusted power level of the output power is selected by a user of the electronic disabling device.

18. The method of claim 17, wherein the adjusted power level of the output power is provided through an electrical switching device, a load for reducing a power level of the output power, and a control logic for receiving a control input from the user of the electronic disabling device to control the electrical switching device to either switch in or switch out the load.

19. The method of claim 17, wherein the adjusted power level of the output power is provided through a tap on a primary coil of the final step-up transformer, an electrical switching device coupled to the tap, and a control logic electrically coupled between the initial step-up voltage circuit and the electrical switching device to effectively reduce the number of windings in the primary coil when the electrical switching device is switched on.

20. The method of claim 17, wherein the adjusted power level of the output power is provided through a plurality of spark gaps, a plurality of electrical switching devices respectively coupled to the plurality of spark gaps, and a control logic electrically coupled between the initial step-up voltage circuit and the plurality of electrical switching devices.

21. The method of claim 17, further comprising:

adjusting a pulse rate of the initial step-up voltage circuit to match an output pulse rate of the electronic disabling device.

* * * * *